US005273445A

United States Patent [19]

Ehrenfels et al.

[11] Patent Number: 5,273,445

[45] Date of Patent: Dec. 28, 1993

[54] LOCKING ELECTRICAL CONNECTOR

[75] Inventors: Alfred L. Ehrenfels, Cheshire; Robert J. Simon, Ansonia, both of Conn.

[73] Assignee: Hubbell Incorporated, Orange, Conn.

[21] Appl. No.: 50,993

[22] Filed: Apr. 22, 1993

Related U.S. Application Data

[63] Continuation of Ser. No. 870,276, Apr. 17, 1992, abandoned.

[51] Int. Cl.[5] ..... H01R 13/44

[52] U.S. Cl. ..... 439/134; 439/680

[58] Field of Search ..... 439/133, 134, 140, 141, 439/304, 332-337, 680

[56] References Cited

U.S. PATENT DOCUMENTS

| | | | |
|---|---|---|---|
| 2,844,805 | 7/1958 | Darrell | 339/37 |
| 3,790,914 | 2/1974 | Hough | 339/14 P |
| 4,241,969 | 12/1980 | D'Dmato et al. | 339/88 R |
| 4,245,875 | 1/1981 | Shaffer et al. | 439/680 |
| 4,653,824 | 3/1987 | Jason et al. | 439/134 |
| 4,673,230 | 6/1987 | Baumgart | 439/133 |
| 4,801,277 | 1/1989 | Seilhan | 439/680 |
| 4,824,402 | 4/1989 | Sorimachi | 439/680 |
| 5,046,961 | 9/1991 | Hoffman | 439/141 |
| 5,108,297 | 4/1992 | Hoffman et al. | 439/141 |
| 5,186,636 | 2/1993 | Beyer et al. | 439/134 |

FOREIGN PATENT DOCUMENTS

| | | | |
|---|---|---|---|
| 2840696 | 3/1980 | Fed. Rep. of Germany | 439/134 |

*Primary Examiner*—Paula A. Bradley

*Attorney, Agent, or Firm*—Jerry M. Presson; Alfred N. Goodman

[57] ABSTRACT

A male electrical connector having an insulating plug body and a cylindrical sleeve surrounding conductive prongs extending from the plug body. The sleeve has at least one aperture in a side wall thereof to removably receive a locking member. The removable locking member is preferably a padlock having a substantially U-shaped shackle extending through the aperture in the sleeve to prevent insertion of the male connector into the mating female connector.

22 Claims, 2 Drawing Sheets

LOCKING ELECTRICAL CONNECTOR

This is a continuation of application Ser. No. 07/870,276 filed Apr. 17, 1992, now abandoned.

FIELD OF THE INVENTION

The present invention is directed to an electrical male connector having a plurality of prongs and having a locking mechanism to prevent inadvertent connection with a female receptacle. In particular, the connector is a shrouded male connector having a lock-out mechanism integrally formed in the wall of the shroud to prevent connection to a female connector.

BACKGROUND OF THE INVENTION

Shrouded electrical connectors are well known in the connector industry. The connectors include at least two, and typically at least three, prongs extending from a housing for joining with a complementary number of holes in a female connector. The male connectors usually include a cylindrical shroud extending from the base and encircling the prongs. The shroud is normally at least as long as the prongs and is often slightly longer than the prongs such that the prongs are slightly recessed in the shroud. The shroud primarily serves to protect the prongs from damage during shipping and handling of the connector. The mating female receptacle may be a cylindrical shape to be received within the shroud or may have a cylindrical recess encircling the prong-receiving holes to receive the shroud.

Electrical conductor assemblies of the locking type to prevent inadvertent connection are also known in the connector industry. The electrical connectors usually include a lock mechanism which encloses the male prongs of the connector or otherwise provides an obstruction to prevent the electrical conductor from being coupled with a female connector. The male and female portions can take various configurations, but the male portion is usually a plug connected to the end of a multi-connector cable. The female portion may also be connected to a similar cable. Alternatively, the female connector may be a fixture or receptacle mounted on a support or a piece of equipment. The male portion is subject to inadvertent connection to a power source which can result in undesirable operation of electrical equipment or electrical shock to an operator and the injuries associated therewith.

Recent regulations enacted by the Occupational Safety and Health Administration (OSHA) require safety mechanisms to prevent the inadvertent and unauthorized connection of electrical conductors. These regulations require a locking mechanism such that the electrical connector cannot be inadvertently connected to a power source while an electrical device is being serviced or otherwise in a condition where the power is undesired. The locking mechanisms must provide limited access and require a key or other security device to prevent unauthorized connection.

Efforts have been made in the past to produce a locking connector and particularly locking male connectors to prevent unauthorized connection. Examples of various locking connectors may be found in U.S. Pat. No. 4,241,969 to D'Amato; U.S. Pat. No. 5,046,961 to Hoffman; U.S. Pat. No. 2,844,805 to Darrell, and U.S. Pat. No. 3,790,914 to Hough.

The above-noted patents disclose locking mechanisms which are relatively complex and expensive to produce. In addition, some of these locking mechanisms are complicated to manufacture and use and require a large number of moving parts which are subject to failure. Furthermore, some of the previous locking mechanisms have not provided the necessary security to prevent unauthorized use of the connector.

SUMMARY OF THE INVENTION

The disadvantages and limitations of the lock-out devices for electrical connectors are obviated by the present invention. It is, accordingly, an object of the invention to provide a male connector with a locking mechanism to prevent inadvertent and unauthorized connection to a female connector.

A further object of the invention is to provide a male electrical connector that is relatively simple to manufacture and use.

Another object of the invention is to provide a male electrical connector provided with a shroud having a locking mechanism removably coupled to the shroud.

Another object of the invention is to provide an electrical connector having a locking mechanism with a relatively few number of parts and which is resistant to mechanical failure such that the connector can be easily coupled to a female connector when the locking mechanism is removed from the connector.

Another object of the invention is to provide a male electrical connector with a shroud having a locking mechanism to interfere with the coupling of the male connector with a female connector when in a locked condition.

The above objects of the present invention are attained by providing a male electrical connector having an insulating plug body having first and second longitudinal ends and being adapted to receive an electrical cable through the first longitudinal end;

a plurality of conductive prongs extending axially from the second long end of the insulating plug body, the plurality of conductive prongs being shaped and dimensioned for insertion into openings in a mating female connector;

a sleeve having an outer surface, an end face, and extending axially from the second longitudinal end of said insulating plug body to encircle the plurality of conductive prongs, the sleeve having a length substantially corresponding to a length of the plurality of conductive prongs; and a lock-out mechanism including at least one hole formed in the sleeve and at least one removable locking member mounted in the at least one hole and projecting axially over the end face of the sleeve.

The foregoing objects of the invention are further attained by providing an insulating plug body having a plurality of conductive prongs for insertion in openings in a mating female connector, a sleeve extending from the insulated body with the prongs situated within the sleeve, a plurality of holes in the sleeve, and a plurality of padlocks, each having a U-shaped shackle extending through respective ones of the holes and being removably coupled to the sleeve.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings which form a part of the disclosure.

DETAILED DESCRIPTION OF THE INVENTION

Figure 1:
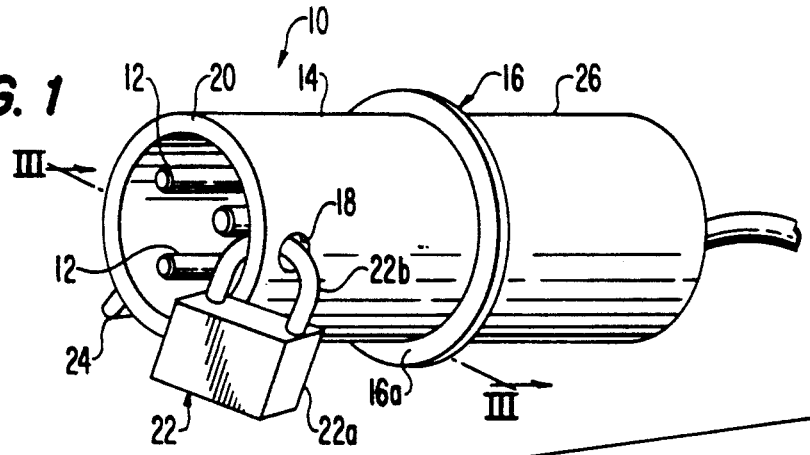
FIG. 1 is a front perspective view of the male electrical connector in accordance with the invention, with the removable locking mechanism attached thereto.
Figure 2:
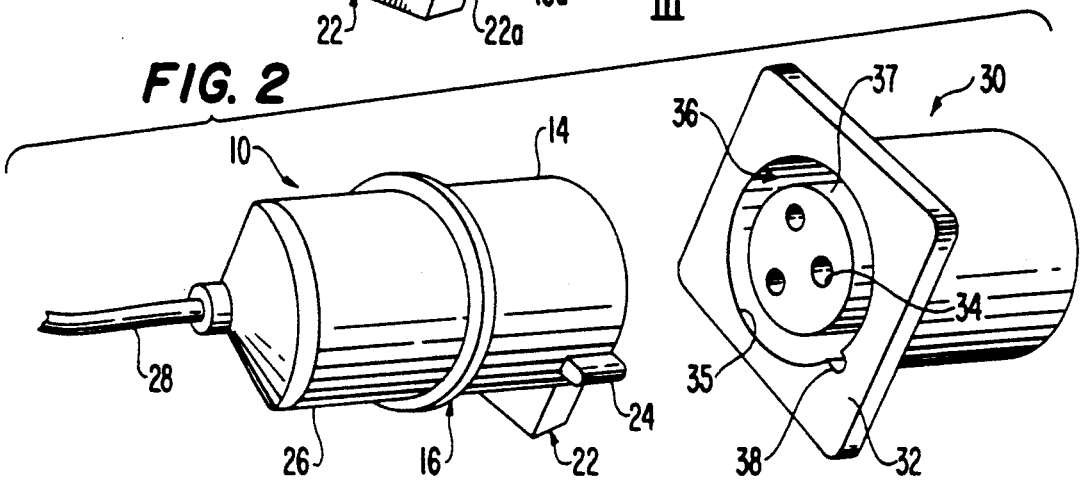
FIG. 2 is a rear perspective view of the male connector as shown in FIG. 1 and showing the mating female electrical receptacle.
Figure 3:
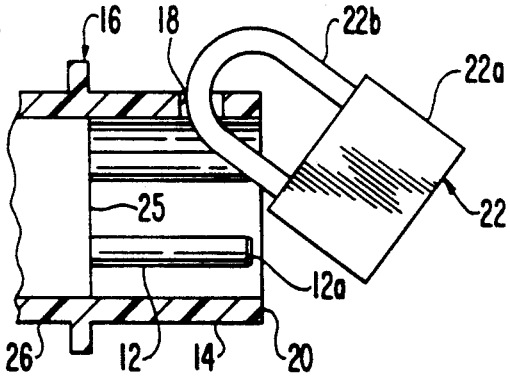
FIG. 3 is a cross-sectional view of the male connector taken along line III—III of FIG. 1 showing the locking mechanism passing through the hole in the sleeve without interfering with the prongs, the locking mechanism being turned slightly from its orientation in FIG. 1 and being shown in FIG. 3 as a side elevation.

The present invention is directed to a male electrical connector including a security lock-out mechanism to prevent unauthorized use of the connector. Referring to FIGS. 1-3 showing a preferred embodiment in accordance with the invention, the male electrical connector 10 includes an insulating plug body 26, a plurality of electrically conductive prongs 12, and a shroud, preferably in the form of a substantially cylindrical sleeve 14. As shown in the embodiment of FIG. 1, three electrically conductive prongs 12 are positioned within the sleeve 14. A hole 18 or suitable aperture is located in a cylindrical sidewall of the sleeve to removably receive a locking mechanism 22.

The plug body 26 provides an insulating base for the conductive prongs 12. As shown in FIG. 2, a cable 28 is connected to one end of the plug body 26 for connection with the conductive prongs 12 in a manner well known in the art. The plug body 26 is typically formed from molded plastic material although other non-conductive materials may be used.

The conductive prongs 12 extend axially from the plug body 26 a distance sufficient to mate with sockets or openings 34 of a female connector 30. The sockets 34 are arranged in a pattern corresponding to the platform of conductive prongs 12. As shown in the embodiment of FIGS. 1-3, the prongs 12 are cylindrically shaped, although other shapes may be used as known in the art. The prongs 12 preferably extend axially from an inner face 25 of the plug body 26 for a distance substantially corresponding to the length of the sleeve 14, which has a proximal end coplanar with the inner face 25 and a distal end defining an end face 20 which preferably extends beyond the ends 12*a* of the prongs 12. As shown in FIG. 3, since the sleeve 14 extends from the plug body 26 a short distance beyond the axial ends 12*a* of the prongs 12, the sleeve 14 prevents inadvertent contact with the prongs and provides the greatest amount of protection to the prongs.

The sleeve 14 extends axially from the plug body 26 surrounding the conductive prongs 12 such that the prongs 12 are situated within sleeve 14. The sleeve 14 is formed of a rigid material to protect the prongs from damage during handling of the connector, and may be integrally formed with the plug body 26 or formed separately and attached to the plug body by suitable means.

Furthermore, sleeve 14 is attached to the plug body 26 to prevent relative movement between the body 26 and the sleeve 14, as seen in FIG. 3.

The sleeve further includes a key 24 extending longitudinally along the outer cylindrical surface of the sleeve 14 to provide alignment and mating of the male connector 10 with the female connector 30. A single key is shown in the embodiment of FIGS. 1-3, although more than one key may be provided. The key 24 or keys may extend for any length of the sleeve 14, but preferably begin in the plane of the end face 20 of the sleeve 14. The key shown in FIGS. 1 and 2 fits into a corresponding groove 38 formed in an inner cylindrical sidewall 35 of the female connector 30 which together with an outer cylindrical surface of a plug body 37 forms an annular space 36 which receives the sleeve 14.

A collar 16 extends radially outwardly from the sleeve 14 to provide a stop member which prevents further insertion of the male connector 10 into the female connector 30 when the end face 16*a* of the collar 16 abuts the base 32 of the female connector 30. The collar preferably extends the full circumference of the sleeve 14 as shown as a complete annulus but may also comprise an arcuate segment other structure which provides an abutment.

The hole 18 in the sleeve is dimensioned and spaced from the axial end face 20 to removably receive a locking device. The hole 18 is preferably located in a position so that the locking mechanism 22 will not interfere with or damage the prongs 12. As shown in FIG. 3, the hole 18 is positioned between two of the prongs 12 such that the locking mechanism 22 does not interfere with the prongs 12. Preferably, the locking mechanism is a conventional padlock having a body 22*a* and a shackle 22*b*. The shackle 22*b* of the locking mechanism 22 extends through the hole 18, between the prongs 12, and over the axial end face 20 of the sleeve 14. In one embodiment of the invention, a single hole 18 is provided in the sleeve 14 such that the locking mechanism, such as a padlock, 22 partially obscures the axial face of the connector 10. In this manner, the locking mechanism 22 prevents the plug from being connected to a female connector. With the locking mechanism coupled to the sleeve as shown in FIG. 3, it is not possible for the prongs 12 to contact the sockets 34 of the female connector 30.

The shackle 22*b* of the lock passes through the hole 18 and over the axial end face 20 of the sleeve in a preferred embodiment. Also, as seen in FIG. 3, either the shackle 22*b* or the body 22*a* extend radially beyond the cylindrical outer surface of the sleeve 14 to prevent insertion into the female connector. Preferably, the hole 18 is spaced from the axial face 20 of the sleeve to enable the lock body to engage the shackle in a locked position. In this manner, the male connector cannot be inadvertently connected to a female connector. The locking mechanism is generally a key or combination type padlock to provide restricted and secured access to the connector, thereby preventing unauthorized use of the connector. Although a padlock or other restricted access locking mechanism is preferred, other locking devices may be used. For example, the locking mechanism may be a threaded bolt threadedly connected to the sleeve such that the bolt extends radially into the sleeve to interfere with coupling of the male connector with the female connector. Alternatively, the locking mechanism may be a rigid or flexible shank having a coupling device or clasp to connect the ends of the shank, such as, for example, a lead seal security wire.

Referring to FIGS. 1 and 2, in use, the male connector 10 is connected to a cable 28 at one end of the insulating base 26. The sleeve 14 is shown with a removable padlock 22 having its shackle 22*b* passing through the hole 18 and over the axial face 20 of the sleeve thereby interfering with mating of the male connector with a female connector. The male connector is normally connected to a female connector 30 by inserting the prongs 12 into the openings 34 in the base 32 of the female connector 30. An annular shaped opening 36 is also provided in the base 32 of the female connector to receive the sleeve 14 of the male connector 10. As shown, the male connector 10 includes three prongs 12 which mate with three complementary openings 34 in the female connector. To provide proper alignment and positioning of the connector, the key 24 is positioned on the sleeve 12 to mate with the groove 38 in the wall of the annular opening 36. As shown in FIG. 2, the male connector cannot be coupled with the female connector until the padlock 22 is removed.

The embodiment of the invention depicted in the FIGS. 1–3 provides an economic and efficient lock-out mechanism for a male electrical connector having a cylindrical sleeve. The locking mechanism can be easily removed and does not interfere with the operation of the male connector after removal of the lock. By providing the locking mechanism as shown, unauthorized use of the connector is prevented and the potential risk of injury to an operator is avoided.

EMBODIMENT OF FIG. 4

Figure 4:
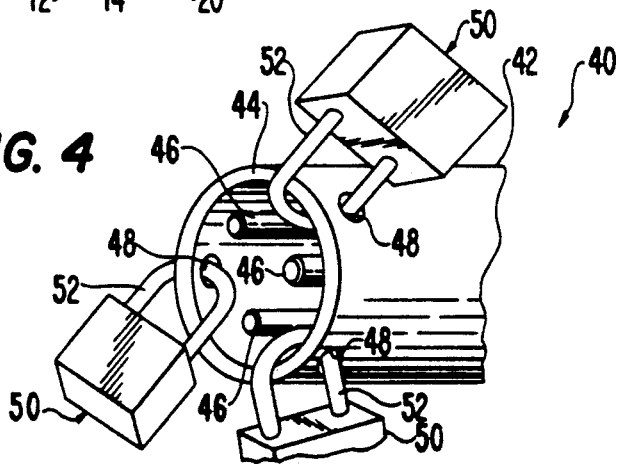
FIG. 4 is a partial front perspective view of a modified male electrical connector in accordance with another embodiment of the invention and showing three holes in the sleeve and three locking mechanisms, each having a shackle passing through a hole to removably couple the locking mechanisms to the sleeve.

In an alternative embodiment of the invention as shown in FIG. 4, the male electrical connector 40 includes a sleeve 42 having an axial end face 44 and three electrically conductive prongs 46 situated within the sleeve substantially the same as the embodiment of FIGS. 1–3. Three holes 48 are spaced circumferentially around the sleeve 42 and spaced a short distance from the axial face 44, the distance being sufficient to prevent forming a thin relatively weak web between the holes 48 and the face 44. The holes 48 are positioned between the prongs so as not to interfere with the prongs by the locking mechanism. As shown, three padlocks 50 having U-shaped shackles 52 extend through the holes 48 and are clasped in the locked position. The shackles 52 of the locks pass through the holes 48 and over the axial face 44 of the sleeve such that the male connector cannot be coupled to a female connector.

The operation of the connector 40 is substantially the same as the embodiment of FIG. 1. A removable lock 50 is passed through the hole 48 such that the shackle passes over the axial face 44. Until the lock 50 is removed, the connector 40 cannot be coupled with a female connector.

EMBODIMENT OF FIGS. 5 AND 6

Figure 5:
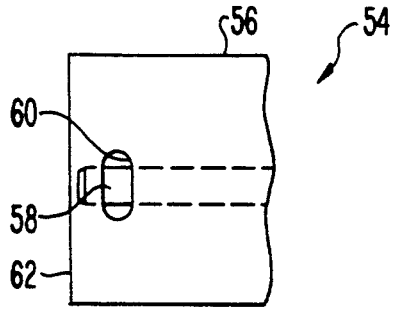
FIG. 5 is a partial side elevational view of a modified electrical conductor showing a sleeve having an elongated hole therein and the location of the hole with respect to the location of the prong.
Figure 6:
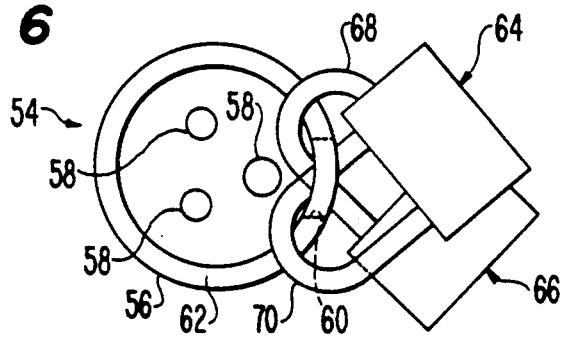
FIG. 6 is an end view of the modified electrical connector of FIG. 5, and showing two locking mechanisms extending through the elongated hole in the sleeve.

In still another embodiment of the invention as shown in FIG. 5 and FIG. 6, the male connector 54 includes a sleeve 56 and prongs 58 positioned within the sleeve. An elongated hole 60 is provided in the sleeve and is positioned with the longitudinal length extending circumferentially around the sleeve. As shown in FIG. 6, the elongated hole 60 is positioned radially outwardly of the prongs. Two removable locking mechanisms, shown as conventional padlocks 64 and 66, have a substantially U-shaped shackles, 68 and 70, respectively, passing through the elongated hole 60 and over the axial face 62 of the sleeve 56. The end view of FIG. 6 shows the shackles 68 and 70 passing through the single elongated hole 60. By providing the elongated hole 60 to receive the shackles of the locks, the hole 60 can be positioned radially adjacent the prong. The shackles can pass through the elongated hole more tangentially to the sleeve 56 so as not to interfere with the prongs. The locks 64 and 66 can be easily removed from the sleeve so that the male connector can be coupled to a female connector.

EMBODIMENT OF FIG. 7

Figure 7:
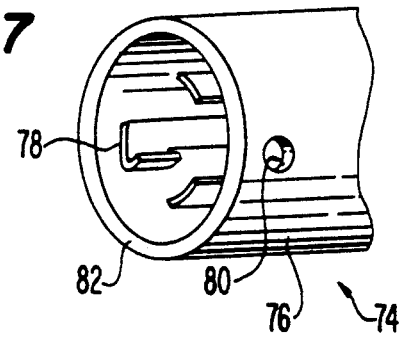
FIG. 7 is a front perspective view of the locking-type male electrical connector having a cylindrical sleeve with a hole for a removable locking mechanism, and three L-shaped locking connector blades within the sleeve.

In a further embodiment of the invention shown in FIG. 7, the male electrical connector 74 includes a sleeve 76 and three substantially L-shaped, arcuate conductor blades 78 of the locking type. A hole 80 is provided in the sleeve to receive the shackle of a lock (not shown) or other suitable locking members, as in the embodiments shown in FIGS. 1–6. The lock shackle (not shown) passes through the hole 80 and over the axial face 82 of the sleeve to prevent the connector from being coupled to a female connector. In operation, the lock is removed from the sleeve and the male connector is coupled to a female connector having arcuate, circularly arranged slots. The male connector is rotated with respect to the female connector after axial insertion therein to lock the connectors together. The conductor blades may be used in any of the other embodiments having more than one hole and more than one locking member. Other shapes and patterns of conductors may also be used.

The above embodiments of the invention have been described and shown using a conventional padlock. The use of a padlock has the advantage of being readily available and providing a secure and effective mechanism for locking the connector and preventing inadvertent or unauthorized connection to a female connector. A conventional padlock can further be used interchangeably with a number of different connectors and can be carried to a work site by an operator. Most importantly, a padlock provides a positive lock-out mechanism to prevent unauthorized connection of the connector to a female connector while the machine or other device is being repaired or serviced and affording an additional safety factor for the service personnel.

EMBODIMENT OF FIGS. 8 AND 9

Figure 8:
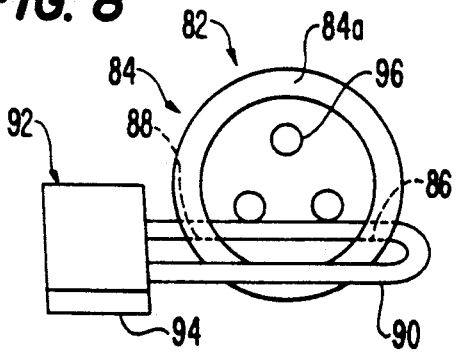
FIG. 8 is an end view of a further modified embodiment of the invention in which the male connector has two opposed holes for receiving a padlock shackle.
Figure 9:
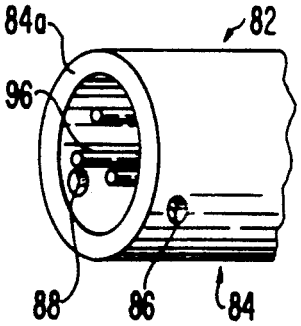
FIG. 9 is a right perspective view of the connector shown in FIG. 8 without the padlock.

In another embodiment, shown in FIGS. 8 and 9, the male connector 82 has a sleeve 84 with two holes 86 and 88 provided therein for receiving a U-shaped shackle 90 of a padlock 92 having a body 94. The shackle passes through both holes 86 and 88 to extend over the axial end face 84*a* of the sleeve 84. In other aspects, the embodiment of FIGS. 8 and 9 is similar to the other embodiments. For example, the holes 86 and 88 are positioned so as not to have the shackle 90 contact the prongs 96. Also, the prongs 96 are preferably not as long as the sleeve so that end face 84*a* of the sleeve extends beyond the ends or tops of the prongs 96. Of course, the prongs may have other suitable shapes and patterns, including that of the FIG. 7 embodiment.

The shackle 90 of the embodiment is elongated to pass through both holes 86 and 88. Moreover, the holes must be positioned axially and radially to define a cord sufficiently close to the center of the sleeve so that the shackle 90 cannot rotate in the holes to the point where the end face 84*a* would be exposed or unobstructed by the lock body or shackle.

While advantageous embodiments have been selected to illustrate the invention, it will be readily understood by those skilled in the art that various modifications and alterations can be made therein without departing from the spirit and scope of the invention as defined in the appended claims.

What is claimed is:

1. A male electrical connector, the combination comprising:

an insulating plug body having first and second longitudinal ends and being adapted to receive an electrical cable through said first longitudinal end;

a plurality of conductive prongs extending axially from said second longitudinal end of said insulating plug body, said plurality of conductive prongs being shaped and dimensioned for insertion into openings in a mating female connector;

a sleeve having an outer surface, and an end face, and extending axially from and being coupled to said second longitudinal end of said insulating plug body to prevent relative movement between said body and said sleeve and to encircle said plurality of conductive prongs, said sleeve having a length substantially corresponding to a length of said plurality of conductive prongs; and a lock-out mechanism including at least one hole formed in said sleeve adjacent said end face and at least one removable locking member mounted in said at least one hole and projecting radially of said sleeve.

2. A male connector according to claim 1, and further comprising a key formed on the outer surface of said sleeve and extending longitudinally thereof, said key being receivable in a complementary groove formed in said mating female connector.

3. A male connector according to claim 1, and further comprising abutment means, extending radially outwardly from said outer surface of said sleeve, for limiting axial extension of said plurality of conductor prongs within said female connector.

4. A male connector according to claim 1, wherein said lock-out mechanism further comprises a plurality of holes and a corresponding number of removable locking members mounted respectively in said plurality of holes.

5. A male connector according to claim 1, wherein said at least one hole is radially positioned between two of said prongs.

6. A male connector according to claim 1, wherein said lock-out mechanism comprises a plurality of holes and a corresponding number of removable locking members, each comprising a padlock having a body and a shackle, said shackle of each padlock passing through a corresponding one of said plurality of holes.

7. A male connector according to claim 1, wherein said at least one removable locking member comprises a padlock having a substantially U-shaped shackle and a body, said shackle being received in said at least one hole.

8. A male connector according to claim 1, wherein said at least one removable locking member projects axially over said end face of said sleeve.

9. A male connector according to claim 1, wherein said at least one hole is an elongated slot.

10. A male connector according to claim 9, wherein said lock-out mechanism comprises two removable locking members, each comprising a padlock having a body and a shackle, wherein both said shackles pass through said elongated slot.

11. A male electrical connector, the combination comprising:

an insulating plug body having first and second longitudinal ends and being adapted to receive an electrical cable through said first longitudinal end;

a plurality of conductive prongs extending axially from said second longitudinal end of said insulating plug body, said prongs being shaped and dimensioned for insertion into openings in a mating female connector;

a sleeve having an outer surface, and an axial end face, and extending axially from and being coupled to said second longitudinal end of said plug body to prevent relative movement between said body and said sleeve and to encircle said plurality of conductive prongs, said sleeve having a length substantially corresponding to a length of said plurality of conductive prongs; and a lock-out mechanism including at least one hole formed in said sleeve adjacent said end face and at least one removable padlock having a body and a shackle, said shackle passing through said at least one hole in said sleeve.

12. A male electrical connector according to claim 11, wherein said shackle of said at least one padlock is substantially U-shaped and extends through said at least one opening and over said axial end face of said sleeve.

13. A male electrical connector according to claim 11, said lock-out mechanism includes a plurality of holes spaced from said axial end face.

14. A male electrical connector according to claim 11, wherein said lock-out mechanism includes two spaced-apart holes, and said shackle of said at least one padlock is substantially U-shaped and extends through each of said two spaced-apart holes.

15. A male electrical connector according to claim 11, wherein said lock-out mechanism includes a plurality of holes and a plurality of padlocks, each said padlock having a body and a shackle, said shackles extending through corresponding ones of said plurality of holes.

16. A male electrical connector according to claim 11, wherein said at least one hole is an elongated slot.

17. A male electrical connector according to claim 16, wherein said lock-out mechanism further comprises a second padlock having a body and shackle, said shackles of said first and second padlocks extending through said elongated slot.

18. A male electrical connector, the combination comprising:

an insulating plug body adapted to receive an electrical cable and having a plurality of conductive prongs extending axially from said plug body;

a substantially cylindrical sleeve extending axially from said plug body a distance at least equal to the distance said prongs extend from said body, said sleeve including a cylindrical outer surface and an axial end face and at least one hole spaced from said axial face;

said prongs and sleeve being shaped and dimensioned for insertion into openings in a mating female connector; and locking means, removably coupled to said sleeve through said at least one hole, for locking out said male electrical connector from said female connector, said locking means extending axially over said end face and radially beyond said cylindrical outer surface of said sleeve.

19. A male electrical connector according to claim 18, wherein said prongs comprise arcuate shaped conductive blades extending from said plug body, said blades being shaped and dimensioned for insertion into and translation in slots formed in a mating female connector as said plug body is moved axially and operationally bout the plug body axis relative to the female connector.

20. A male electrical connector according to claim 18, wherein said locking means comprises a padlock having a substantially U-shaped shackle.

21. A male electrical connector according to claim 18, wherein said sleeve includes a plurality of holes spaced circumferentially about said sleeve.

22. A male electrical connector according to claim 21, wherein said locking means includes a plurality of locking members removably mounted in corresponding ones of said plurality of holes.

* * * * *